US011598269B1

(12) United States Patent
Reichardt et al.

(10) Patent No.: US 11,598,269 B1
(45) Date of Patent: Mar. 7, 2023

(54) AIR INTAKE PLENUM FOR ATTENUATING SOUND FROM A MARINE ENGINE

(71) Applicant: Brunswick Corporation, Mettawa, IL (US)

(72) Inventors: Douglas D. Reichardt, West Bend, WI (US); Ameer B. Ambavaram, Fond du Lac, WI (US); Andrew S. Waisanen, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/693,826

(22) Filed: Mar. 14, 2022

Related U.S. Application Data

(63) Continuation of application No. 17/081,388, filed on Oct. 27, 2020, now Pat. No. 11,359,555.

(51) Int. Cl.

| | |
|---|---|
| ***F02D 9/02*** | (2006.01) |
| ***F02B 61/04*** | (2006.01) |
| ***F02M 35/16*** | (2006.01) |
| ***F02M 35/10*** | (2006.01) |
| ***B63H 20/00*** | (2006.01) |
| ***F02M 35/02*** | (2006.01) |
| ***F02M 35/12*** | (2006.01) |

(52) U.S. Cl.
CPC ..... *F02D 9/02* (2013.01); *B63H 20/001* (2013.01); *F02B 61/045* (2013.01); *F02M 35/0201* (2013.01); *F02M 35/1015* (2013.01); *F02M 35/10144* (2013.01); *F02M 35/1261* (2013.01); *F02M 35/167* (2013.01)

(58) Field of Classification Search
CPC ..... F02D 9/02; B63H 20/001; F02B 61/045; F02M 35/0201; F02M 35/10144; F02M 35/1015; F02M 35/1261; F02M 35/167
See application file for complete search history.

(56) References Cited

U.S. PATENT DOCUMENTS 6,463,902 B1 10/2002 Curtis et al.
6,752,240 B1 6/2004 Schlagenhaft
(Continued)

FOREIGN PATENT DOCUMENTS

FR 2743848 7/1997

OTHER PUBLICATIONS

Executed Declaration of Prior Art submitted in Corresponding U.S. Appl. No. 17/081,388, on Oct. 27, 2020.

*Primary Examiner* — Jacob M Amick
*Assistant Examiner* — Charles J Brauch
(74) *Attorney, Agent, or Firm* — Andrus Intellectual Property Law, LLP

(57) ABSTRACT

An intake plenum is for a marine engine, the marine engine having first and second throttle devices for controlling flow of intake air to the marine engine. The intake plenum has an airbox providing an expansion volume, first and second inlets that convey the intake air in parallel to the expansion volume, first and second outlets that convey the intake air in parallel from the expansion volume to the first and second throttle devices, and first and second Helmholtz-style attenuator devices located at the first and second outlets, respectively. Together the first and second inlets, expansion volume, and first and second Helmholtz-style attenuator devices are configured to attenuate different frequencies of sound emanating from the marine engine via the first and second outlets.

18 Claims, 10 Drawing Sheets

(56) References Cited

U.S. PATENT DOCUMENTS

| | | | | |
|---|---|---|---|---|
| 7,021,262 | B1 | 4/2006 | Belter et al. | |
| 9,359,981 | B1 | 6/2016 | Waisanen et al. | |
| 9,732,712 | B1 | 8/2017 | Biel | |
| 9,784,218 | B1 | 10/2017 | Waisanen | |
| 9,909,545 | B1 | 3/2018 | Waisanen et al. | |
| 10,180,121 | B1 * | 1/2019 | Waisanen | F02M 35/167 |
| 10,344,719 | B1 | 7/2019 | Wald et al. | |
| 10,724,410 | B1 | 7/2020 | Waisanen | |
| 2009/0269999 | A1 | 10/2009 | Schaub et al. | |

* cited by examiner

AIR INTAKE PLENUM FOR ATTENUATING SOUND FROM A MARINE ENGINE

CROSS REFERENCE TO RELATED APPLICATION

This application is a continuation of U.S. patent application Ser. No. 17/081,388, filed Oct. 27, 2020, which is incorporated herein by reference in its entirety.

FIELD

The present disclosure relates to marine drives and particularly to air intake plenums having features for attenuating sound emanating from a marine drive.

BACKGROUND

The following U.S. Patents are incorporated herein by reference:

U.S. Pat. No. 10,344,719 discloses an intake system for a marine drive. The intake system comprises a throttle device that receives intake air for combustion; an intake conduit that conveys the intake air to the throttle device, wherein the intake conduit has an upstream inlet end, a downstream outlet end, and a radially outer surface that extends from the upstream inlet end to the downstream outlet end; and an intake silencer coupled to the radially outer surface and configured to attenuate sound emanating from the intake system.

U.S. Pat. No. 10,180,121 discloses an outboard motor having an internal combustion engine and a cowl covering the engine. An air vent allows intake air into the cowl, an air intake duct routes the intake air from the air vent to the engine, and a throttle body meters flow of the intake air from the air intake duct into the engine. A sound enhancement device is located proximate the throttle body. A sound duct is provided which has an inlet end located proximate the sound enhancement device and an outlet end located proximate an outer surface of the cowl. The sound enhancement device is tuned to amplify a first subset of sounds having a desired frequency that are emitted from the throttle body, and the sound duct transmits the amplified sounds to an area outside the cowl. A method for modifying sounds produced by an air intake system of an outboard motor is also provided.

U.S. Pat. No. 9,909,545 discloses an outboard motor having an internal combustion engine powering the outboard motor and a cowl covering the engine and having a vent allowing air under the cowl. A throttle body meters flow of the air into the engine and an intake structure downstream of the throttle body delivers the metered airflow to one or more combustion chambers in a cylinder block of the engine. A sound enhancement assembly in acoustic communication with the intake structure collects sounds emitted by the engine. The sound enhancement assembly is configured to amplify a subset of the collected sounds that have frequencies within a desired frequency range. A method for modifying sounds produced by an air intake system of an internal combustion engine powering an outboard motor is also disclosed. The method includes positioning a sound enhancement assembly in acoustic communication with an air intake passageway located downstream of the engine's throttle body.

U.S. Pat. No. 9,784,218 discloses an air intake system for a marine engine having a throttle body and a throttle plate that is rotatably supported within the throttle body. The throttle plate is rotatable to regulate air flow through the throttle body from a first region on a first side of the throttle plate to a second region on a second side of the throttle plate. An air conduit has an air conduit inlet and an air conduit outlet. A noise cancelling device comprises a pass-through chamber. The pass-through chamber has a chamber inlet that receives the air flow from the air conduit, a chamber outlet that discharges the air flow to the idle air control valve, and a pass-through interior between the chamber inlet and chamber outlet. The pass-through chamber is configured to cancel noise emanating from the idle air control valve.

U.S. Pat. No. 9,359,981 discloses an outboard motor including a system for enhancement of a first subset of sounds having a desired frequency, and a method for modifying sounds produced by an air intake system for an internal combustion engine powering the outboard motor. The method includes collecting sounds emitted in an area proximate a throttle body of the engine. A first subset of the collected sounds, which have frequencies within desired frequency range, are then amplified. The amplified first subset of sounds are then transmitted to an area outside a cowl covering the engine.

U.S. Pat. No. 6,752,240 discloses a sound attenuating system which allows a relatively unobstructed airflow conduit to be associated with chambers that reflect various frequencies of sound back towards the source of the sound. The chambers are arranged in a coaxial association with the primary airflow conduit and are sized to reflect a certain range of frequencies of sound. Holes extend through the airflow conduit, in a radial direction, to place the airflow conduit in fluid communication with the chambers which surround portions of the conduit.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter. In examples herein disclosed, an intake plenum is for a marine engine, the marine engine having first and second throttle devices for controlling flow of intake air to the marine engine. The intake plenum has an airbox providing an expansion volume; first and second inlets that convey the intake air in parallel to the expansion volume; first and second outlets that convey the intake air in parallel from the expansion volume to the first and second throttle devices; and first and second Helmholtz-style attenuator devices at the first and second outlets, respectively. Together the first and second inlets, the expansion volume, and the first and second Helmholtz-style attenuator devices are configured to attenuate different frequencies of sound emanating from the marine engine via the first and second outlets.

BRIEF DESCRIPTION OF THE DRAWINGS

The present disclosure is described with reference to the following Figures.

DETAILED DESCRIPTION

Figure 1:
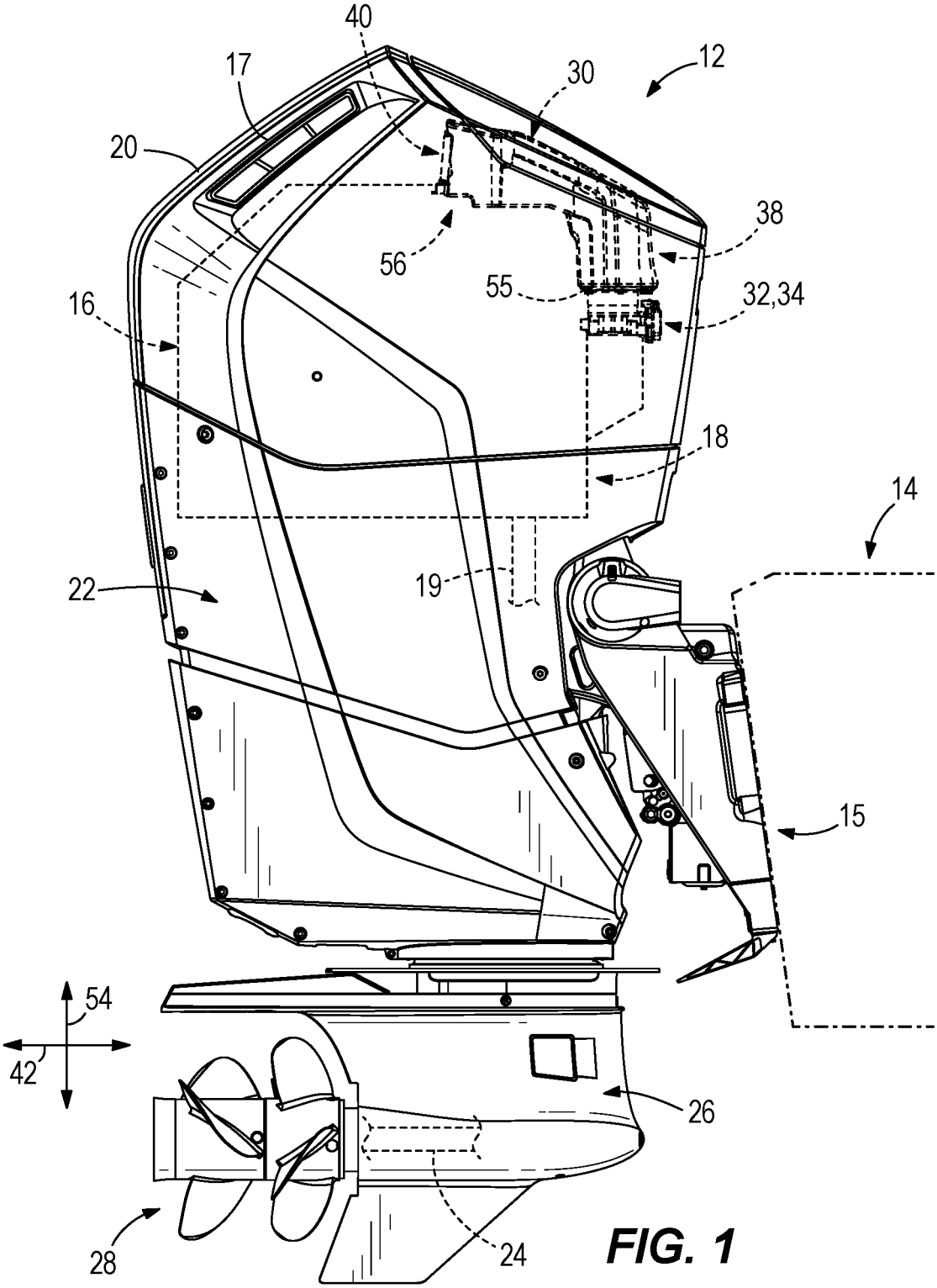
FIG. 1 is a starboard side view of an outboard motor coupled to a marine vessel shown in dash-and-dot lines via a transom bracket. The outboard motor has a combustion engine shown in dashed lines and a novel air intake plenum is mounted to the engine and specially configured to provide intake air to the engine and attenuate different frequencies of sound emanating from the engine.

FIG. 1 is a starboard side view of an outboard motor 12 for propelling a marine vessel 14 in water. A transom bracket 15 couples the outboard motor 12 to the marine vessel 14, as is conventional. The outboard motor 12 has an internal combustion engine 16, which in this example is a V-style engine having a plurality of cylinders; including a port-side bank of aligned cylinders extending transversely relative to a starboard-side bank of aligned cylinders. The number and configuration of cylinders can vary from what is herein shown and described. The engine 16 is disposed in a powerhead compartment 18, which is partially defined by a top cowl 20. Operation of the engine 16 causes rotation of a driveshaft 19, which extends into a midsection housing 22 located below the powerhead compartment 18. As conventional, the driveshaft 19 is operably coupled in torque-transmitting relationship to a propeller shaft 24 extending from a lower gearcase 26. Rotation of the driveshaft 19 causes rotation of the propeller shaft 24, which in turn causes rotation of propellers 28 on the propeller shaft 24 to thereby generate a thrust force that propels the outboard motor 12 and the marine vessel 14 in the water.

During research and experimentation, the present inventors recognized a need for an improved air intake plenum for a marine engine, and in particular non-limiting examples for an outboard motor configuration having an engine with an odd firing order and throttle bodies that emit sounds having broad range of frequencies, including at least between 200 Hz and 800 Hz. The inventors endeavored to invent such an air intake plenum for use within a relatively small available area in the powerhead compartment 18, in particular without interfering with other engine components. The inventors found it was quite challenging to achieve the above objectives, particularly with respect to attenuation of sounds in a mid-frequency range of about 500 Hz to 800 Hz. The present disclosure provides inventions that overcome these challenges.

A novel air intake plenum 30 according to the present disclosure is specially configured to convey the intake air from inside the powerhead compartment 18 to the engine 16 via port and starboard throttle devices 32, 34, and also to effectively attenuate a wide range of sounds emanating from the engine 16 via the respective throttle devices 32, 34, including high, low, and mid-range sound frequencies, as will be further explained herein below with reference to FIGS. 2-8.

Figure 2:
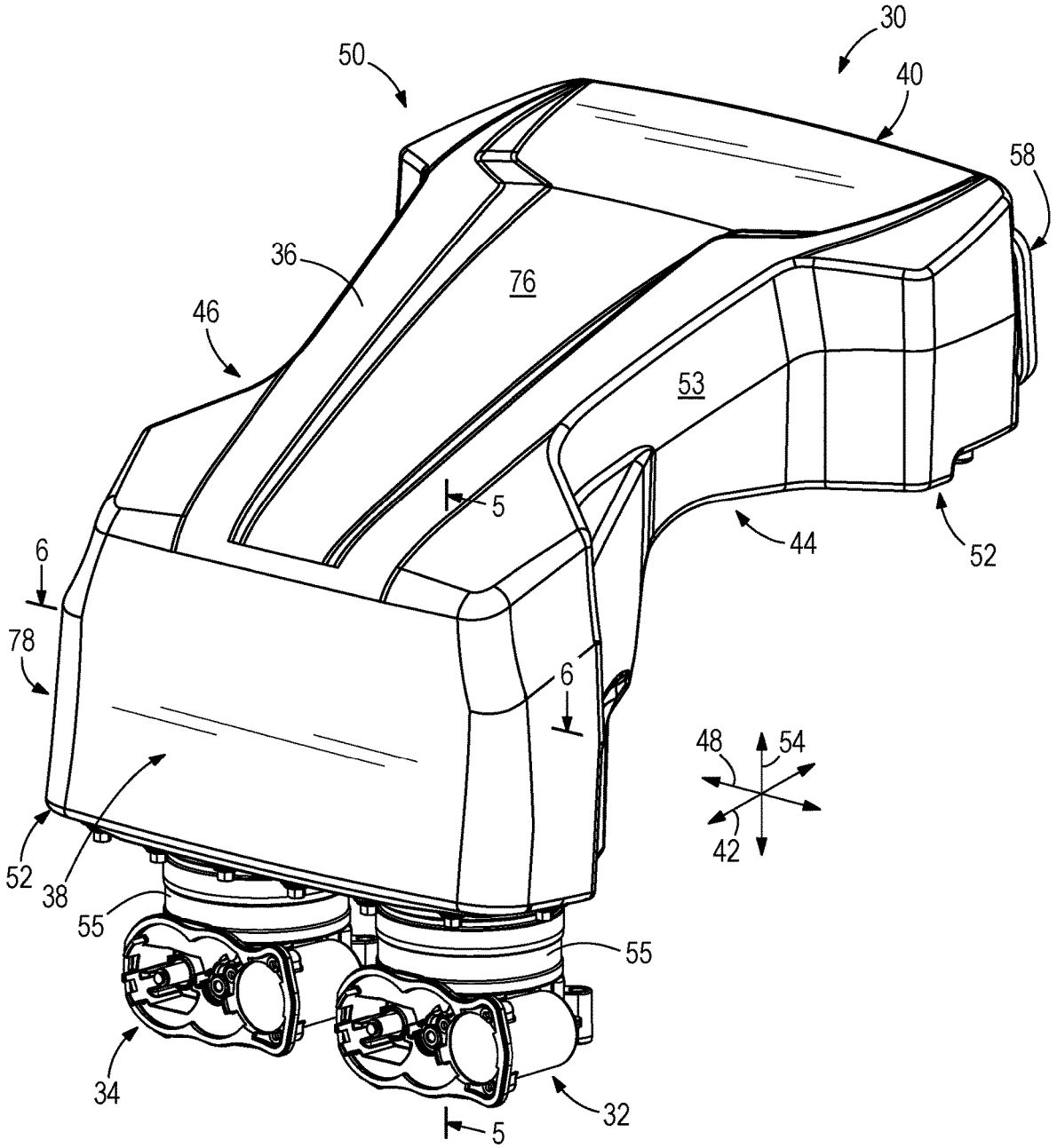
FIG. 2 is a port side perspective view looking down at the air intake plenum.
Figure 3:
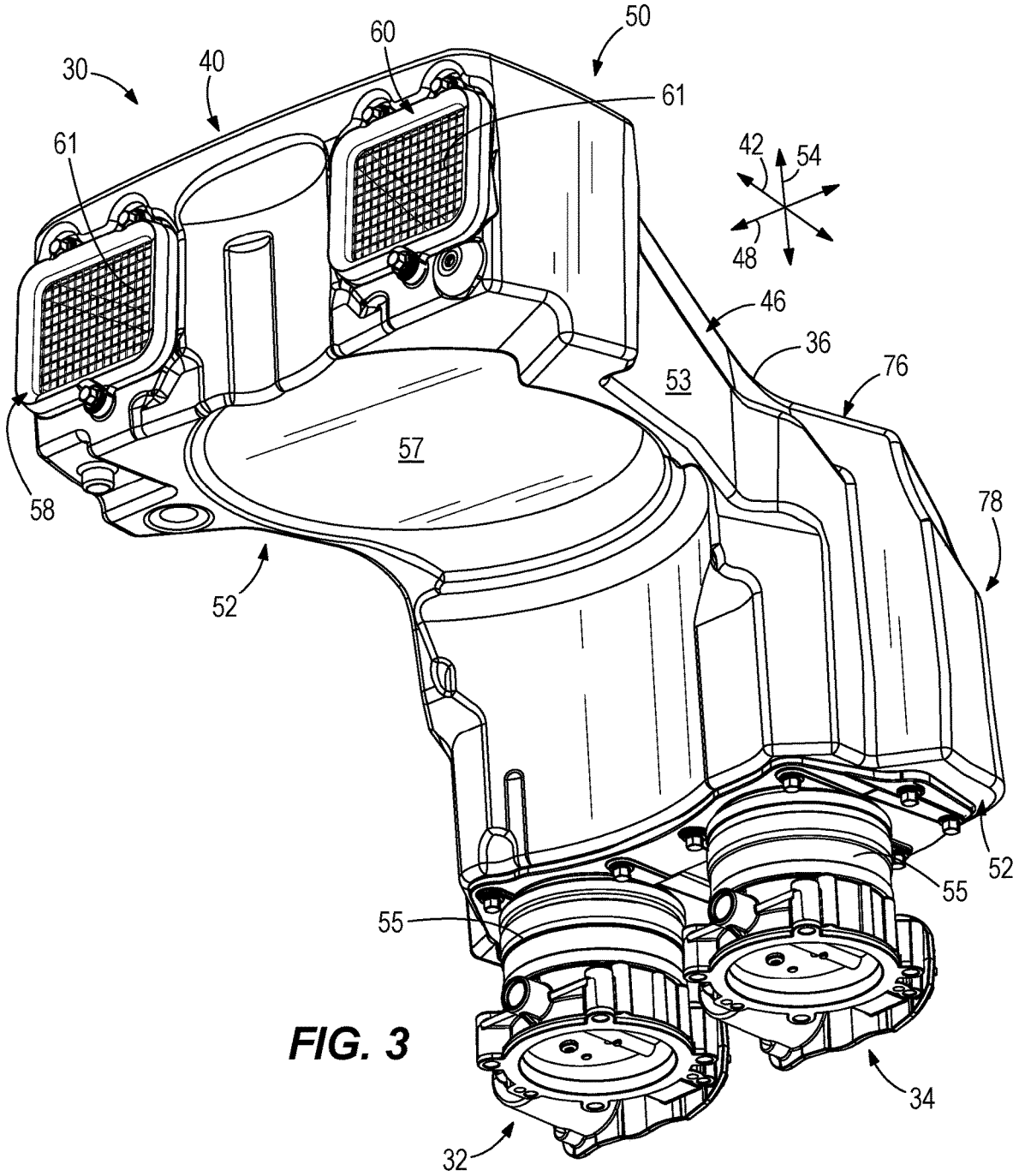
FIG. 3 is a starboard side perspective view looking up at the air intake plenum.

Referring to FIGS. 2-3, the air intake plenum 30 includes a three-dimensional airbox 36 which extends from front 38 to rear 40 in a longitudinal direction 42, from port side 44 to starboard side 46 in a lateral direction 48 which is transverse to the longitudinal direction 42, and from top 50 to bottom 52 in an axial direction 54 which is transverse to the longitudinal direction 42 and transverse to the lateral direction 48. The front 38, particularly along the bottom 52, is mounted to the port and starboard throttle devices 32, 34. The rear 40, particularly along the bottom 52, is mounted to the engine 16. In the illustrated example, the front 38 is mounted to the throttle devices 32, 34 via resilient rubber couplings 55. The rear 40 is mounted via brackets (not shown) extending from lifting eyes of the engine 16, generally at the location of reference number 56 in FIG. 1. The airbox 36 is located on top of an flywheel (not shown) of the engine 16, generally at the location of reference number 57 in FIG. 3. The location and manner of mounting of the air intake plenum 30 to the engine 16 can vary from what is herein shown and described. As will be further described herein below with reference to FIGS. 4-8, the airbox 36 comprises a sound attenuating expansion volume 59 (see FIG. 5). The intake plenum 30 also has port and starboard inlets 58, 60 that convey the intake air in parallel from the powerhead compartment 18 to the expansion volume 59, and port and starboard outlets 62, 64 (see FIG. 8) that convey the intake air in parallel from the expansion volume 59 to the port and starboard throttle devices 32, 34, respectively, for introduction to the engine 16. The intake air enters the powerhead compartment 18 via intake air openings 17 (see FIG. 1) in the top cowl 20.

Figure 4:
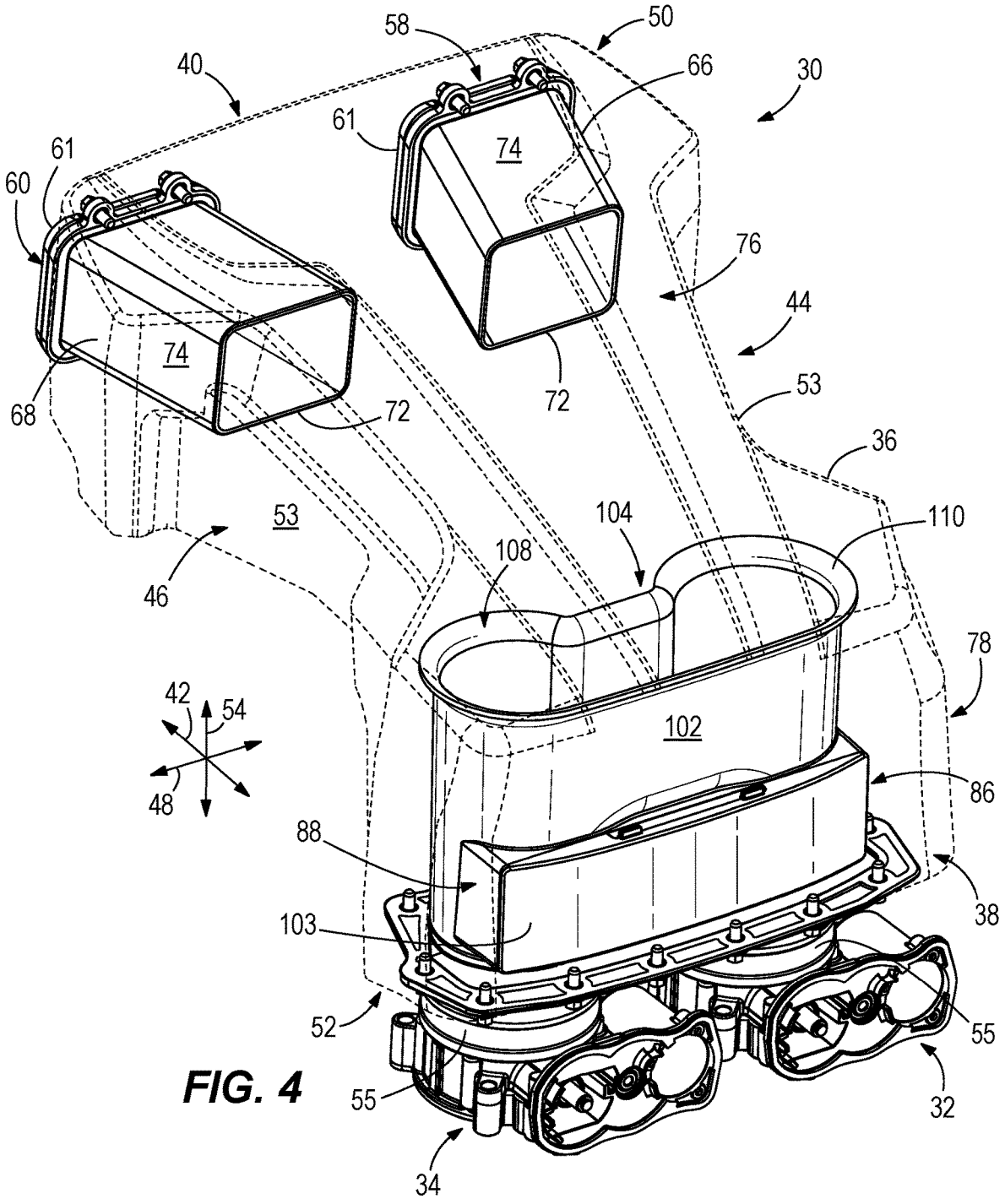
FIG. 4 is a starboard side perspective view looking down at the intake air plenum, with portions of the plenum shown in dashed lines.
Figure 5:
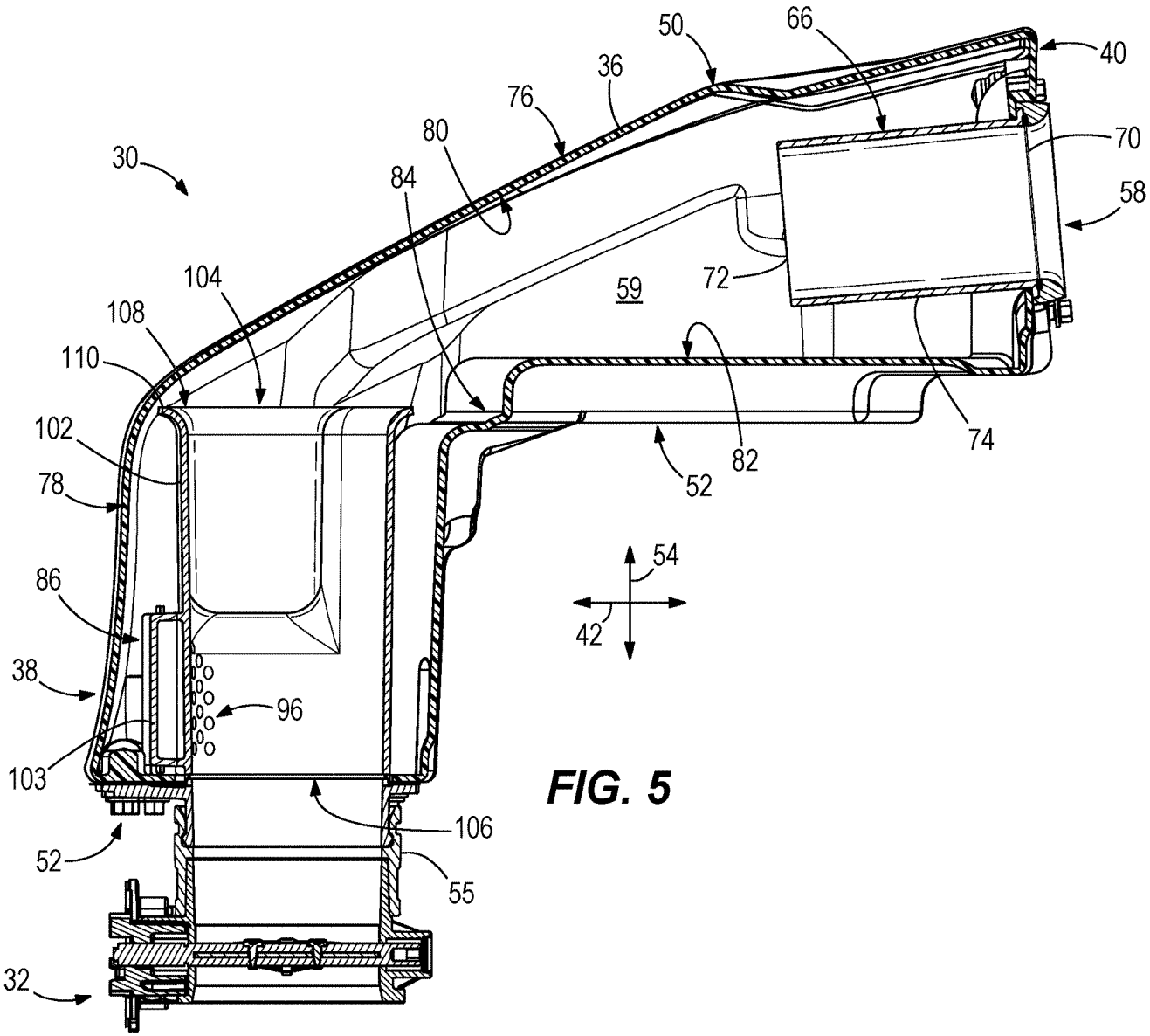
FIG. 5 is a view of section 5-5, taken in FIG. 2.
Figure 8:
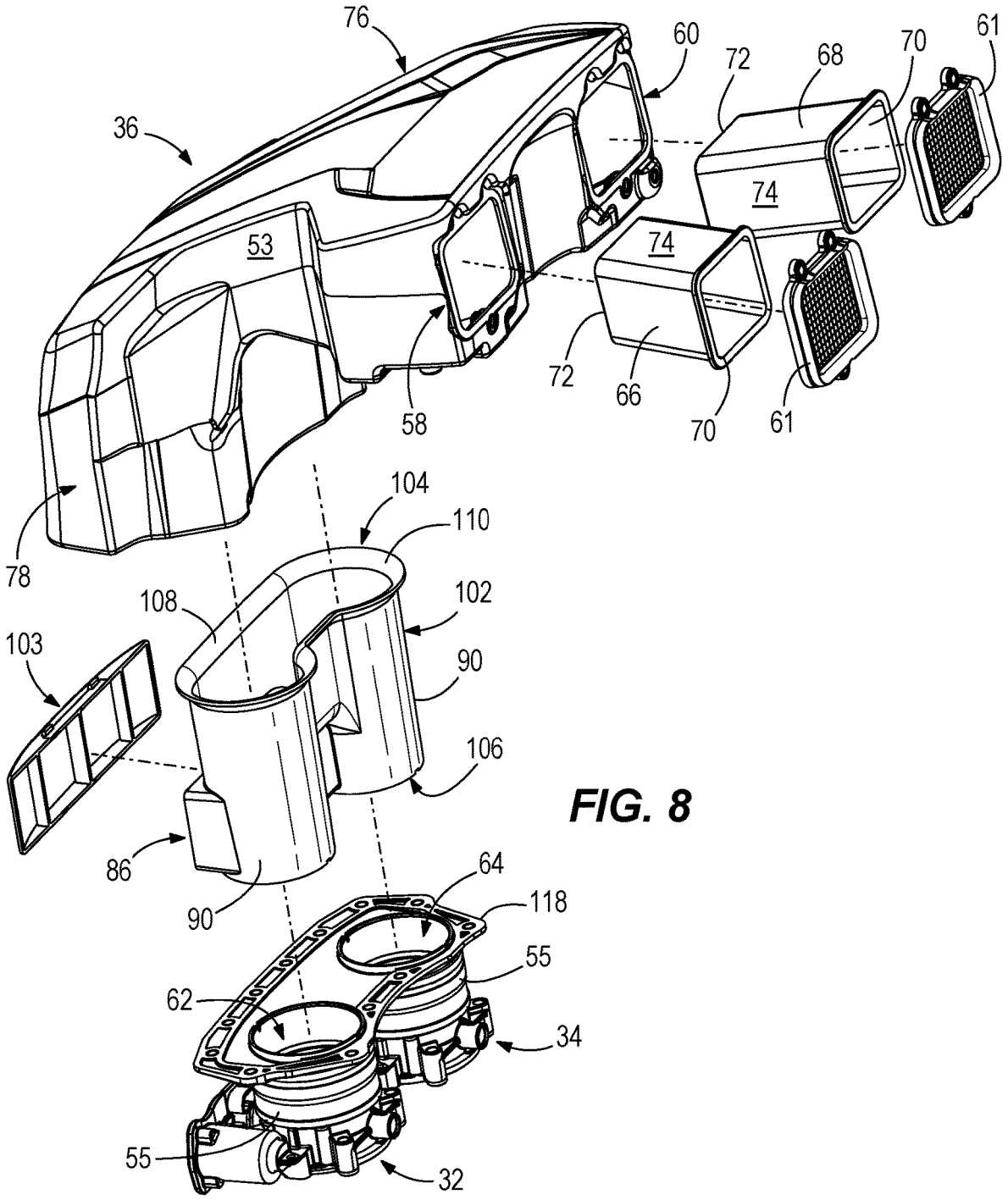
FIG. 8 is an exploded view of the air intake plenum.

Referring to FIGS. 4-5 and 8, the airbox 36 is generally L-shaped when viewed from the port and starboard sides 44, 46, and such that the port and starboard inlets 58, 60 are facing along the longitudinal direction 42 and the port and starboard outlets 62, 64 are facing along the axial direction 54, transversely relative to the port and starboard inlets 58, 60. Referring to FIG. 8, the port and starboard inlets 58, 60 are spaced apart from each other, and each has a wire mesh cover 61 that filters particulate material from the incoming intake air. Referring to FIG. 4, imperforate port and starboard inlet air ducts 66, 68 extend from the port and starboard inlets 58, 60, into the expansion volume 59. Each of the port and starboard inlet air ducts 66, 68 has an inlet end 70 (see FIG. 5.) that receives the intake air, an outlet end 72 (see FIGS. 4, 5) that discharges the intake air to the expansion volume 59, and an elongated body 74 that extends from the inlet end 70 to the outlet end 72. The port and starboard inlet air ducts 66, 68 are generally rectangular-shaped having rounded corners, and are splayed or angled inwardly towards each other so that the respective outlet ends 72 are closer together than the respective inlet ends 70.

The airbox 36 generally has an elongated inlet portion 76 that houses the port and starboard inlet air ducts 66, 68, and an elongated outlet portion 78 that depends from the inlet portion 76, extending in the axial direction 54, generally transversely to the inlet portion 76. As can be seen in FIG. 4, the medial sidewall portions 53 of the port and starboard sides 44, 46 of the airbox 36 are smoothly tapered inwardly towards each other so that the airbox 36 narrows along the inlet portion 76 from the outlet ends 72 of the port and starboard inlet air ducts 66, 68 towards the outlet portion 78. The inlet portion 76 slopes generally downwardly with respect to the axial direction 54 from the port and starboard inlets 58, 60 towards the outlet portion 78. As such, referring to FIG. 5, the inside upper surface 80 of the airbox 36 is angled downwardly relative to the outlet ends 72 of the port and starboard air ducts 66, 68 so as to efficiently deflect airflow downwardly towards and into the outlet portion 78. The opposing inside lower surface of the airbox 36 has a rounded shoulder 84 across which facilitates smooth redirection of the flow of intake air from the inlet portion 76 to the outlet portion 78.

Figure 6:
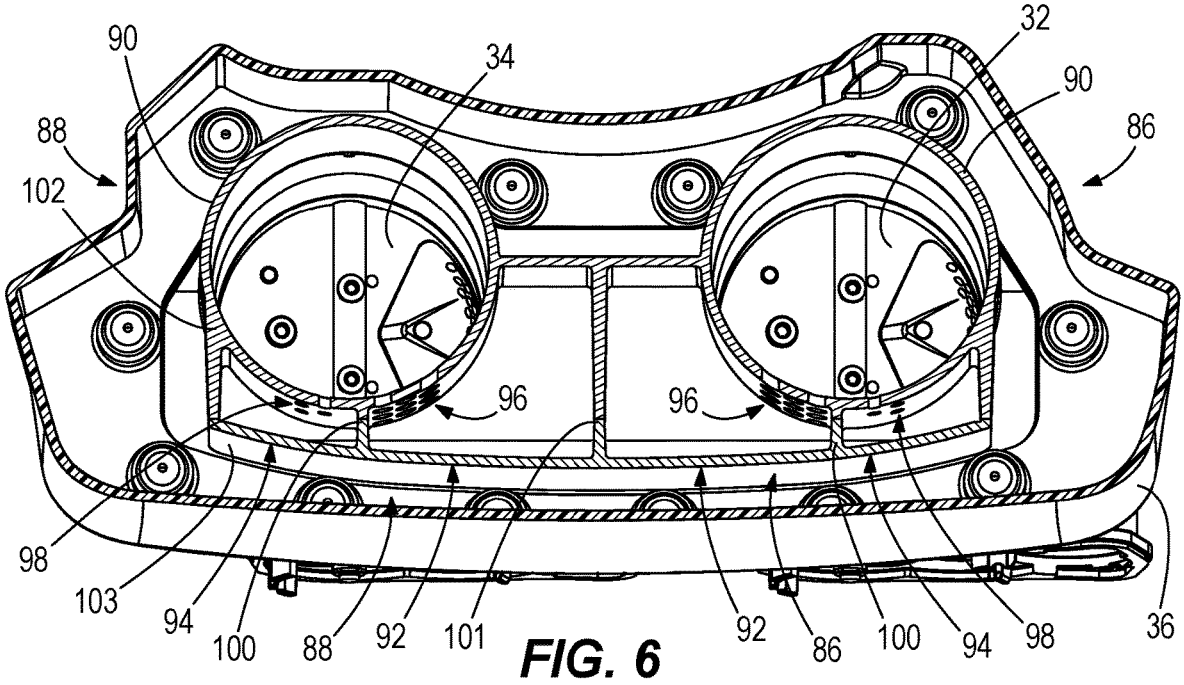
FIG. 6 is a view of section 6-6, taken in FIG. 2.

Referring to FIGS. 5-9, port and starboard concentric-style, Helmholtz-style attenuator devices 86, 88 (resonators) are located at the port and starboard outlets 62, 64, respectively. Each of the port and starboard Helmholtz-style attenuator devices 86, 88 has a cylindrical air duct 90 (see FIG. 5) that conveys the intake air, attenuation chambers 92, 94 (see FIGS. 6 and 9) located radially outside of and alongside the air duct 90, and first and second pluralities of attenuation holes 96, 98 in the air duct 90 (see FIG. 9), which connect the air duct 90 to the attenuation chambers 92, 94, respectively. The attenuation chambers 92 have a larger volume (e.g., 0.15 liter) than the attenuation chambers 94 (e.g., 0.03 liter). The first plurality of attenuation holes 96 includes thirteen attenuator holes of 5.5 mm diameter, arranged in three columns. The second plurality of attenuation holes 98 of has four attenuator holes of 3.5 mm diameter, arranged in two columns. As shown in FIG. 6, the attenuation chambers 92, 94 are located next to each other on one radial side of the air duct 90 and share a common wall 100 that radially extends from the air duct 90. In the illustrated example, the attenuation chambers 92, 94 of the port Helmholtz-style attenuator device 86 are located next to the attenuation chambers 92, 94 of the starboard Helmholtz attenuator device 88 and a central wall 101 separates the respective attenuation chambers 92. A removable cover 103 is fastened to the port and starboard Helmholtz-style attenuator devices 86, 88 and encloses the attenuation chambers 92, 94.

Figure 7:
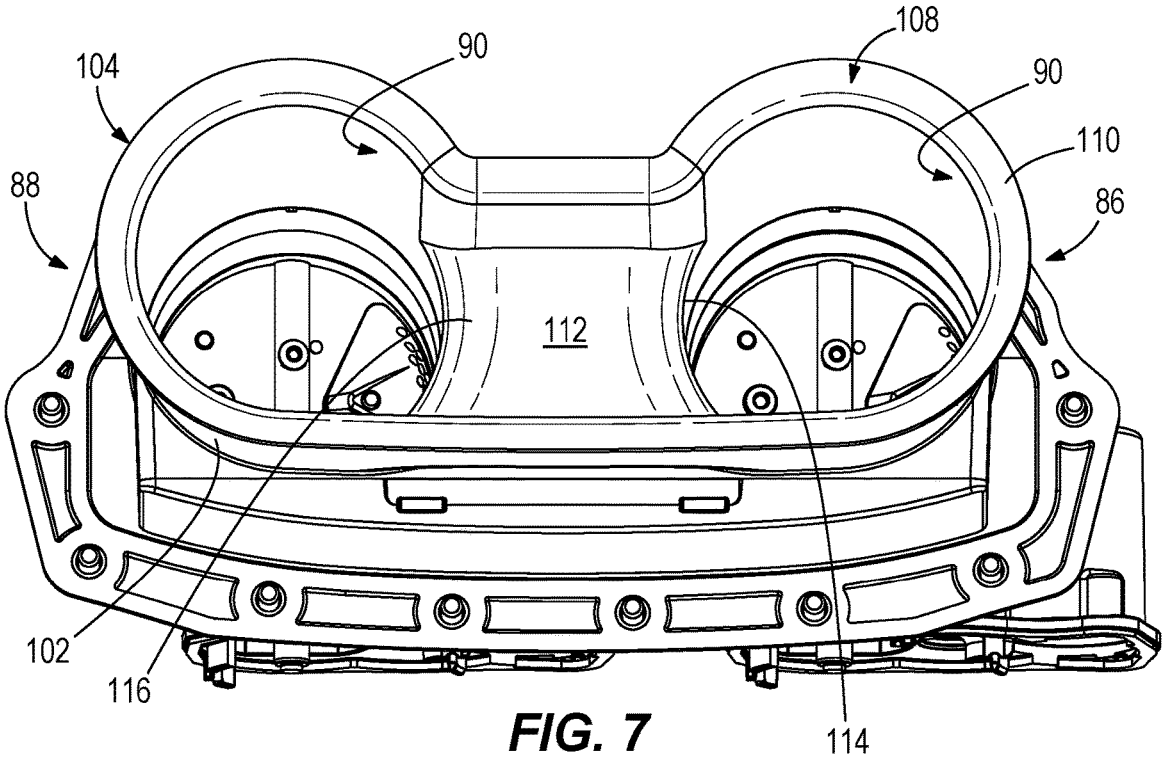
FIG. 7 is a view looking down at first and second outlets of the air intake plenum, each including a Helmholtz-style attenuator device.
Figure 9:
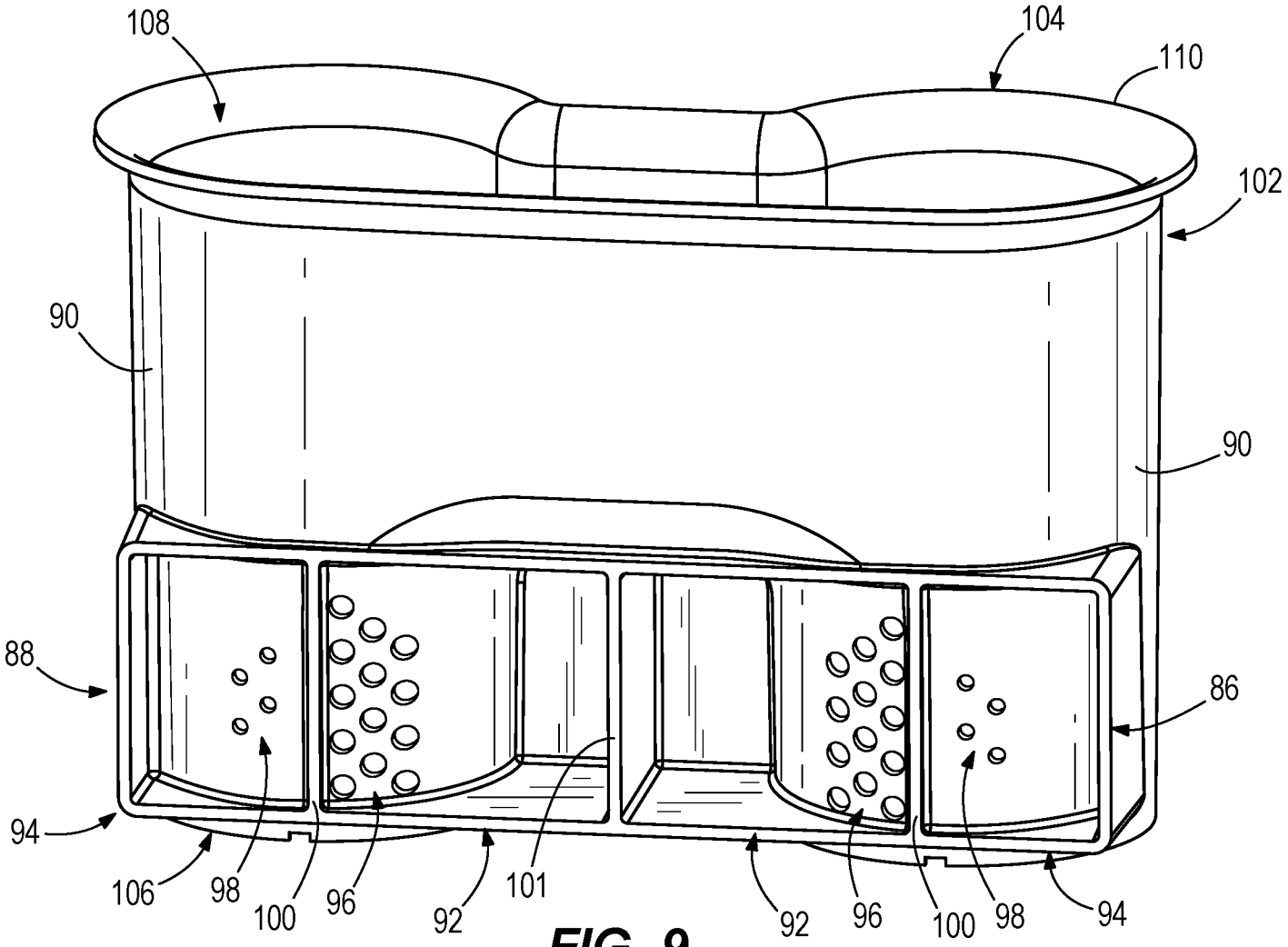
FIG. 9 is a side view of the Helmholtz-style attenuator devices.

Referring to FIGS. 5 and 9, the Helmholtz-style attenuator devices 86, 88 are formed together as a monolithic housing 102 having an oblong trumpeted inlet end 104 that receives intake air from the expansion volume 59 and an outlet end 106 that discharges the intake air to the throttle devices 32, 34, which in turn control discharge of the intake air to the engine 16, as conventional. The housing 102 defines the port and starboard air ducts 90. Referring to FIG. 5, the inlet end 104 has a bell mouth 108 which efficiently funnels and bifurcates the intake air from the expansion volume 59 to the port and starboard Helmholtz-style attenuator devices 86, 88. Referring to FIG. 7, the bell mouth 108 has a rounded outer perimeter 110 and a sunken inner transition portion 112 between the port and starboard air ducts 90 and sunken with respect to the outer perimeter 110. The inner transition portion 112 has opposing port and starboard rounded sides 114, 116, which together with the rounded outer perimeter 110 efficiently funnel and bifurcate the intake air into the port and starboard air ducts 90. Together, the inside upper surface 80 of the airbox 36, rounded shoulder 84 of the lower surface 82 of the airbox 36, and bell mouth 108 are configured to efficiently transition the flow of intake air from the elongated inlet portion 76 to the elongated outlet portion 78. Referring to FIG. 8, the housing 102 is seated in a base tray 118, which is coupled to the airbox 36 at the bottom of the elongated outlet portion 78, and in turn is mounted onto port and starboard throttle devices 32, 34 via the rubber couplings 55.

The geometry (i.e., shape and size) of the air intake plenum 30 and its components are specially tuned to attenuate a certain range of frequencies. For example, the length of the port and starboard inlet air ducts 66, 68 is tuned to attenuate certain frequencies. Similarly, the length of the outlet ducts 90 are tuned to attenuate a certain range of frequencies. The shape (e.g. height and width) of the airbox 36 is also tuned to attenuate a certain range of frequencies. The number and configuration (size and alignment) of the attenuation chambers 92, 94 and attenuation holes 94, 96 are configured to attenuate certain ranges of frequencies. The geometry of the airbox 36, including the inside upper surface 80, rounded shoulder 84, and bell mouth 108 are configured to together prevent recirculation within the airbox 36 and facilitate improved flow of intake air with less restriction. The inventors further determined that division of the inflow of intake air via the port and starboard inlet ducts 66, 68 to the common expansion volume 59, and the division of the outflow of the intake air via the Helmholtz-style attenuator devices 86, 88 surprisingly effectively attenuated sound having a wide range of frequencies.

Figure 10:
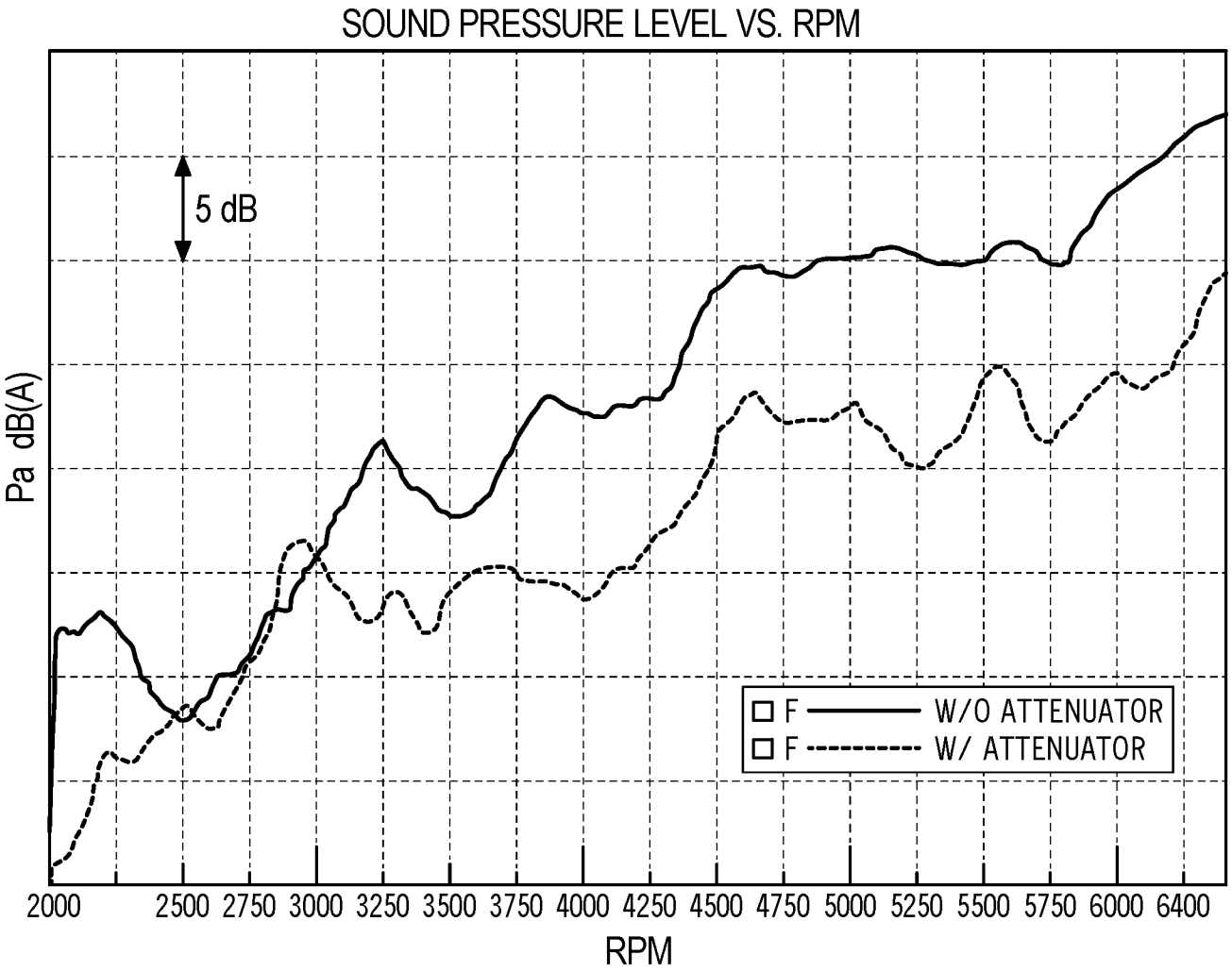
FIG. 10 is a graph showing sound pressure level versus engine speed for an example outboard motor, configured with and without the air intake plenum according to the present disclosure.
Figure 11:
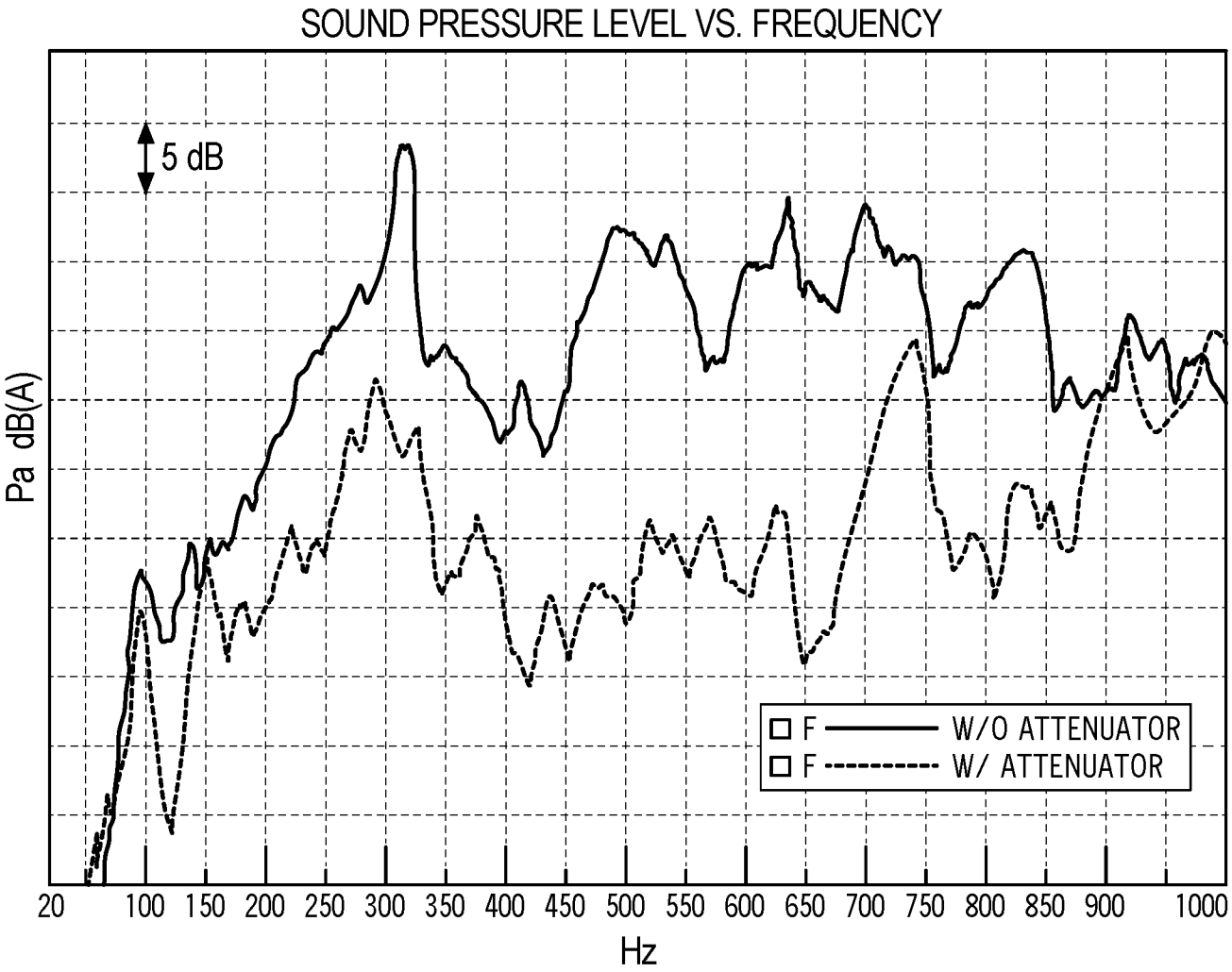
FIG. 11 is a graph showing sound pressure level versus frequency for an example outboard motor configured with and without the air intake plenum according to the present disclosure.

FIGS. 10 and 11 are graphs that depict the performance improvements accomplished by the presently disclosed air intake plenum 30 compared to operation of the engine 16 without it. FIG. 10 illustrates reduced sound pressure across nearly all speeds (RPM) of the engine 16. FIG. 11 illustrates reduced sound pressure at nearly all sound frequencies emitted from the engine 16.

The present inventors determined that minor changes to the shape and/or size of the airbox 36 that were necessary to accommodate the above-described size constraints had a significant impact on attenuation of sounds in the mid-frequency range of 500 HZ to 800 Hz compared to a relatively less significant impact on attenuation of sounds in the low frequency range of 200 Hz to 500 Hz. To overcome this challenge, the inventors conceived of the port and starboard Helmholtz-style attenuator devices 86, 88 having the extended air ducts 90, which advantageously increased attenuation of sounds in the mid frequency range and reduced the sensitivity of the airbox geometry changes to this frequency range. The inventors also realized that the elongated port and starboard (inlet) air ducts 66, 68 and elongated port and starboard outlet air ducts 90 can be shaped and sized (i.e. tuned) to attenuate particular ranges of sound frequencies that are not otherwise attenuated by the expansion volume 59. However, tuning of these features is somewhat limited by the overall geometry (size and shape) of the airbox 36, particularly in view of the above-noted design space constraints. There are physical limits on the length of these features, as well as practical limits where flow restrictions result in performance loss. Thus added functional benefit of the Helmholtz-style attenuator devices 86, 88 is that they provide minimal flow restriction. The attenuation chambers 92, 94 are advantageously located radially outside of the air duct 90 and thus outside of the main flow of intake air. Thus the Helmholtz-style attenuator devices 86, 88 are efficiently packaged with the expansion volume 59, which minimizes packaging space and provides a wider range of frequency reductions, particularly with respect to the mid-frequency range, compared to what a larger expansion volume would provide on its own.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An intake plenum for a marine engine, the marine engine having at least one throttle device for controlling flow of intake air to the marine engine, the intake plenum comprising an airbox providing an expansion volume; at least one inlet which conveys the intake air in parallel to the expansion volume; at least one outlet which conveys the intake air in parallel from the expansion volume to the at least one throttle device; and at least one Helmholtz-style attenuator device located at the at least one outlet, wherein together the at least one inlet, the expansion volume, and the at least one Helmholtz-style attenuator device are configured to attenuate different frequencies of sound emanating from the marine engine, respectively.

2. The intake plenum according to claim 1, wherein the at least one Helmholtz-style attenuator device comprises an air duct which conveys the intake air, first and second attenuation chambers located alongside the air duct, and first and second pluralities of attenuation holes in the air duct which connect the air duct to the first and second attenuation chambers, respectively.

3. The intake plenum according to claim 2, wherein the first attenuation chamber has a larger volume than the second attenuation chamber.

4. The intake plenum according to claim 3, wherein the first plurality of attenuation holes comprises thirteen attenuator holes and wherein the second plurality of attenuation holes comprises four attenuator holes.

5. The intake plenum according to claim 4, wherein the thirteen attenuator holes are arranged in three columns of attenuator holes and wherein the four attenuator holes are arranged in two columns of attenuator holes.

6. The intake plenum according to claim 2, wherein the air duct is cylindrical.

7. The intake plenum according to claim 2, wherein the first and second attenuation chambers are next to each other and share a common wall radially extending from the air duct.

8. The intake chamber according to claim 7, wherein the first and second attenuation chambers are located on only one side of the air duct.

9. The intake plenum according to claim 2, further comprising a cover which encloses the first and second attenuation chambers.

10. The intake plenum according to claim 2, further comprising a bell mouth which extends from the at least one Helmholtz-style attenuator device into the expansion volume and funnels the intake air from the expansion volume to the at least one Helmholtz-style attenuator device.

11. The intake plenum according to claim 10, wherein the bell mouth comprises a rounded outer perimeter which funnels the intake air inwardly towards the at least one Helmholtz-style attenuator device.

12. The intake plenum according to claim 1, wherein the at least one inlet is transversely oriented relative to the at least one outlet.

13. The intake plenum according to claim 12, further comprising an air duct which extends from the at least one inlet into the expansion volume.

14. The intake plenum according to claim 13, wherein the air duct is rectangular having rounded corners.

15. The intake plenum according to claim 13, wherein the air duct has and inlet end which receives the intake air, an outlet end which discharges the intake air to the expansion volume, and an elongated body which extends from the inlet end to the outlet end.

16. The intake plenum according to claim 13, wherein the airbox has a first elongated portion extending generally parallel to the duct and a second elongated portion which depends from the first elongated portion and extends generally transversely to the first elongated portion.

17. The intake plenum according to claim 16, wherein the first elongated portion narrows inwardly from the air duct to the second elongated portion.

18. The intake plenum according to claim 16, wherein the at least one Helmholtz-style attenuator device is located in the second elongated portion, and further comprising a bell mouth which funnels the intake air from the expansion volume to the at least one Helmholtz-style attenuator device, wherein the bell mouth facilitates transitioning of the intake air from the first elongated portion to the second elongated portion.

* * * * *